United States Patent [19]

Yazidjian

[11] 4,452,183

[45] Jun. 5, 1984

[54] METHOD AND DEVICE FOR UNCLOGGING THE TOP SURFACE OF THE TUBE PLATE OF A STEAM GENERATOR

[75] Inventor: Jean-Claude Yazidjian, Bougival, France

[73] Assignee: Framatome & CIE., Tour Fiat, France

[21] Appl. No.: 377,482

[22] Filed: May 12, 1982

[30] Foreign Application Priority Data

May 22, 1981 [FR] France ..... 81 10204

[51] Int. Cl.[3] ..... F22B 37/52

[52] U.S. Cl. ..... 122/392; 15/318; 122/390

[58] Field of Search ..... 122/379, 382, 390, 391, 122/392; 15/316 R, 316 A, 318

[56] References Cited

U.S. PATENT DOCUMENTS 3,311,092 3/1967 McMahon et al. ..... 122/392

4,273,076 6/1981 Lahoda et al. ..... 122/390 X

*Primary Examiner*—Edward G. Favors

*Attorney, Agent, or Firm*—Pollock, Vande Sande & Priddy

[57] ABSTRACT

The invention relates to a method and device for unclogging the top surface of the tube plate of a steam generator comprising, in a cylindrical vessel, a bundle of bent tubes of inverted U-shape and connected to a tube plate. The unclogging is achieved by two water jets under high pressure coming from projection heads and which can be directed towards the tube plate. These two water jets are moved simultaneously and symetrically with respect to the diametric boundary line of two zones in the form of a semi-circle on the tube plate. At the same time the detached sludge is removed by aspiration of this sludge throughout the length of the peripheral zone of the tube plate.

4 Claims, 7 Drawing Figures

METHOD AND DEVICE FOR UNCLOGGING THE TOP SURFACE OF THE TUBE PLATE OF A STEAM GENERATOR

FIELD OF THE INVENTION

The present invention relates to a method and a device for unclogging the top surface of the tube plate of a steam generator.

PRIOR ART

Steam generators of pressurized water nuclear reactors generally include a cylindrical jacket of great height within which a bundle composed of a large number of bent tubes of inverted U-shape is arranged. Each tube is connected through its two ends to a tube plate arranged horizontally in the vicinity of the lower part of the steam generator, above the lower dished end of this generator.

The lower part of the steam generator situated beneath the tube plate forms two substantially identical compartments bounded by the lower dished end and by a vertical separating partition. One of the compartments communicates through the tube plate with one end of all the tubes, while the other compartment communicates with the other end of all the tubes.

The pressurized water bringing the heat from the core of the nuclear reactor to the steam generator is introduced into one of the compartments, circulates in the tubes, comes back into the other compartment and returns into the core of the nuclear reactor. By passsing through the tubes, this water yields a portion of its heat by vaporizing the feed water which is contained in the jacket of the generator and which surrounds the tubes. The steam produced is removed at the upper part of the steam generator and is sent to the turbine associated with the electrical generator. Then this steam is condensed into the form of feed water which is reintroduced into the steam generator.

In spite of treatments applied to the feed water, its presence in the steam generator causes during the operation of the latter, over long periods, the formation of sludge which accumulates on the tube plate around the base of the U-tubes, particularly at the place of the fluid-tight joints of the tubes and the tube plate produced by welding.

This sludge is composed principally of iron oxide, in particular magnetite, which is the cause of corrosion phenomena of the tubes at the level of the tube plate. A leak at the level of the tubes which causes a passage of primary water into the steam circuit being considered as a serious accident where a nuclear reactor is concerned, very special attention must be given to avoid these corrosion phenomena. Consequently, periodic unclogging of the top surface of the tube plate is provided for, in order to remove sludge which is deposited there.

To carry out this operation, it has already been proposed to arrange inside the generator, above the tube plate, a mobile lance sending a water jet under high pressure in the direction of the base of the tubes. It is known to arrange this lance so that it is moved in a diametric direction of the steam generator, passing in the central zone which is devoid of tubes.

On the other hand, various installations have been proposed for removing sludge formed during the unclogging operation. Thus, it is known e.g., from French Patent No. 2,352,269 to cause the circulation of a water jet on the periphery of the tube plate, this water jet being intercepted and evacuated to the outside of the steam generator after having traversed a half revolution, driving in its passage, and so evacuating, the sludge to the extent that it arrives at the periphery of the tube plate.

It has also been proposed to effect the evacuation of the sludge, by introducing through the same orifice as that which serves for the passage of the water lance, a flexible suction tube which is guided so as to be positioned approximately at the peripheral zone of the tube plate.

Finally, it has been proposed to give the tube plate a funnel shape so as to remove the sludge by gravity, the lowest point of the tube plate being at the center and comprising outflow means at this spot.

These various arrangements have certain drawbacks. The method of evacuation by peripheral water circulation does not enable homogeneous drainage to be obtained, since the removal is only effected at a single point. The evacuation device using a flexible tube threaded temporarily into the steam generator is not very reliable, since the tube can become twisted or positioned irregularly on the tube plate. A the device using a funnel-shaped tube plate is of little interest, since the tube plate being a main part it is preferably given the simplest possible geometric shape, for example, a flat shape. The latter method is moreover limited to a steam generator the water of which includes a central column.

In addition, a common point of these unclogging methods is to carry out the projection of the cleaning water by using a single projection head which is moved either throughout the length of a diameter of the steam generator, or the length of a radius of this generator. In the latter case, the cleaning operation is carried out in two stages: introduction of the water lance through an orifice formed in the jacket of the steam generator and cleaning the corresponding tube half-plate, followed by introduction through a diametrically opposite orifice and cleaning the other tube half-plate. By operating in one or the other of these ways, it is possible that sludge may move from a zone in the course of cleaning to a zone which is already cleaned.

SUMMARY OF THE INVENTION

It is an object of the present invention to provide a method and a device for unclogging intended to overcome these drawbacks.

According to the present invention, there is provided a method of unclogging the top surface of the tube plate of the steam generator comprising, in a cylindrical vessel with a vertical axis, a vertical bundle of bent tubes of inverted U-shape, connected at each of their lower ends to the flat horizontal tube plate fast to the vessel of the steam generator, a high temperature fluid being led to the tubes of the bundle above the tube plate to supply heat enabling vaporization of the feed water introduced into the steam generator.

According to an essential feature of the invention, there is provision for positioning, in the vessel containing the tube bundle, two high pressure water jets which can be directed toward different points of the tube plate, one of the water jets sweeping a first semi-circular-shaped zone of the tube plate, the other water jet sweeping the complementary semi-circular-shaped zone of the tube plate, said two water jets moving simultaneously and symmetrically with respect to the diametric boundary line of the two zones of the tube plate. In addition, evacuation for the sludge detached by the water jets is achieved by aspiration of this sludge throughout the length of the peripheral zone of the tube plate.

According to a particular feature of the invention concerning a device for unclogging in accordance with said method, two lance heads projecting high pressure water are positioned in the direction of the tube plate, these two heads moving independently of one another along a same horizontal axis situated above the tube plate, these two heads being animated by an oscillating movement around said same axis, the movement of the heads along this axis being effected step by step, by a value equal to the distance separating two rows of tubes, so that the water jets emerging from the lances pass successively between each row of tubes. The lance heads are preferably displacable in a diametric direction of thesteam generator situated in the free space left between the bundle of tubes simultaneous displacement means being provided for the two lance heads so that their position remains always symmetrical with respect to the central axis of the steam generator in order to sweep the whole of the tube plate symmetrically.

According to another feature of the invention, there is provided an evacuation device for the sludge, constituted by at least one tube situated above the tube plate, at a relatively short distance, and arranged at the periphery of the tube plate, in the vicinity of the cylindrical vertical jacket of the steam generator, this tube including orifices directed towards the bottom of the steam generator, and at least one connection of this evacuation tube to a pipe opening on the outside of the steam generator, and connected to an aspiration device.

Other advantages inherent in this invention will appear from the detailed description of the embodiments which follow, illustrated by the accompanying Figures.

DETAILED DESCRIPTION

Figure 1:
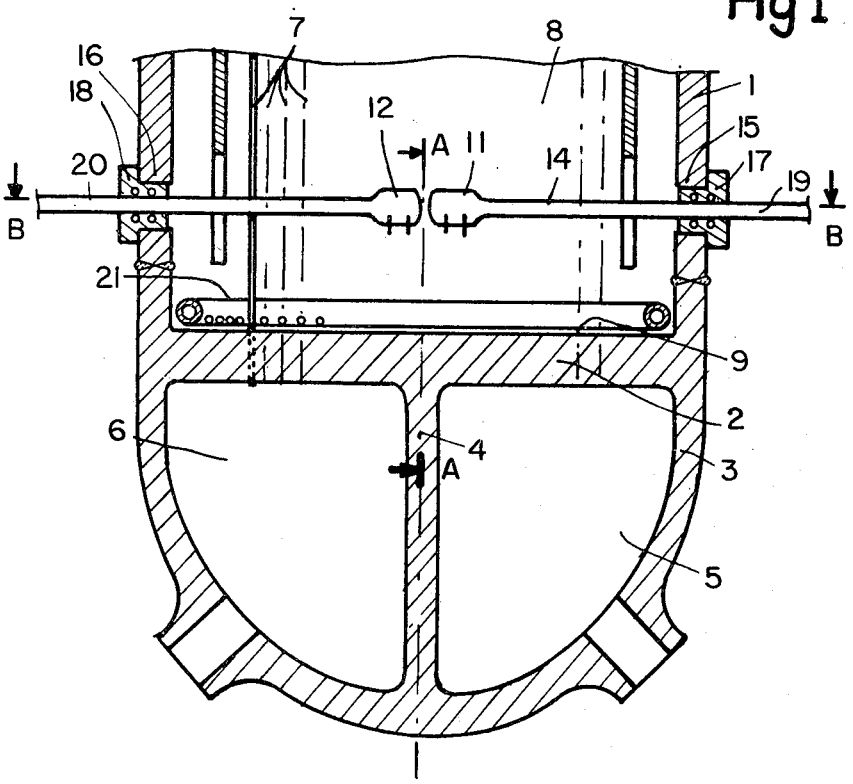
FIG. 1 shows a sectional view through a vertical plane of symmetry of the lower part of the steam generator in which is to be found the device for unclogging and recovery of sludge.

FIG. 1 shows the whole lower part of a steam generator constituted essentially by an outer cylindrical jacket 1 arranged vertically, closed downwardly by a plate 2 positioned horizontally. Beneath this plate is arranged a hemispherical jacket 3 comprising a vertical fluid-tight partition 4 which thus bounds two chambers 5 and 6. Plate 2 comprises a series of tubes 7 which pass through it and which are welded in fluid-tight manner to it. Each of these tubes 7 is of inverted U-shape the two lower ends of which open respectively into each of the chambers 5 and 6.

The steam generator operates as follows: The hot water coming from the core of the reactor is introduced into the chamber 6, passes into the set of tubes 7, reemerges in the chamber 5, then returns to the core of the reactor. On passage in the tubes 7, this hot water yields its heat to a feed water contained in the chamber 8, converting this feed water into steam which rises towards the top part of the steam generator and which is sent into the turbines. In normal operation of the generator, a sludge deposit is eventually produced on the upper surface 9 of the tube plate 2. This steam generator comprises, in addition, a set of devices enabling the unclogging of the sludge on the top surface of the tube plate 2 to be carried out, to be described in more detail below.

Figure 2:
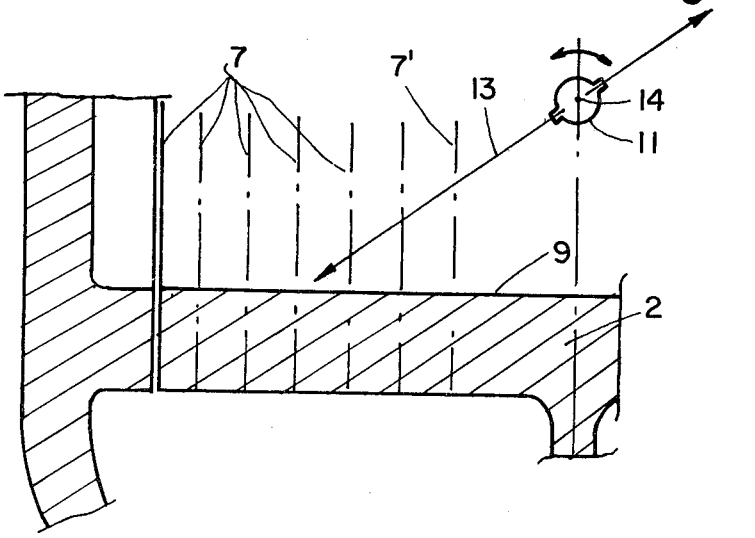
FIG. 2 is a simplified half-view in section along the line A—A of FIG. 1.

The unclogging principle adopted in the present invention is illustrated by the diagrammatic FIG. 2. This figure shows tube plate 2, on which tubes 7 are fixed vertically, all these tubes being arranged in equidistant manner so as to form a tube bundle. This tube bundle extends over the major portion of the tube plate 2, but not to the center itself thereof. The tubes 7' closest to the central axis 10 are in fact at a certain distance, in order to allow for the minimum radius of curvature of their U-shape. In the vicinity of the central axis 10 there is hence a region devoid of tubes, in which are arranged the projection heads 11 and 12. In FIG. 2 are distinguished the projection heads 11 supplied with water at high pressure, and including a series of nozzles. In operation, the projection heads are animated with an oscillating movement around the longitudinal axis of the water lances, so that the water jets shown by the arrow 13 cover the whole surface of the tube plate. The water jets which follow the direction 13 are in a vertical plane which is perpendicular to the longitudinal axis of the lances 11, 12. During the projection of the water jets, a movement along the longitudinal axis of the lances 11 thus enables these water jets to reach the totality of connecting points between the tubes 7 and the tube plate 2.

Referring to FIG. 1, there will not be described the arrangement and mode of operation of the lance heads 11, 12. In the jacket 1 of the steam generator, above the tube plate, are two openings 15 and 16 enabling the introduction into the steam generator of the lance heads 11, 12 and in these openings are arranged bearings 17, 18 which enable longitudinal movement along the axis 14 of the straight reeds 19, 20 which support the lance heads 11, 12 as well as their oscillating movement. The reeds constitute at the same time an inlet pipe for the pressurized water into these lance heads.

Figure 3:
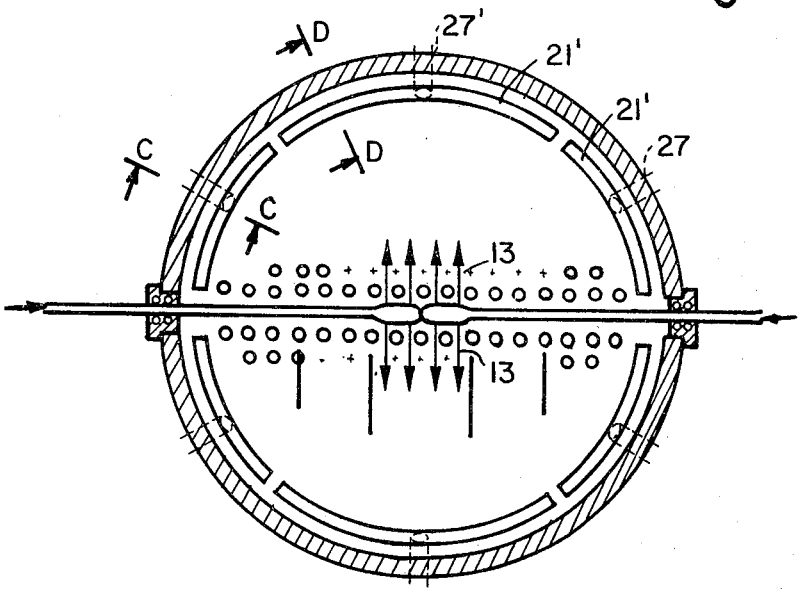
FIG. 3 is a sectional view along the line B—B of FIG. 1.

Referring to FIGS. 1 and 3, there will now be described the method of unclogging according to the invention. At the start of the unclogging operation, the reeds 19, 20 are fully thrust into the steam generator so that the lance heads 11,12 are almost in abutment at the level of the center of the steam generator. At this moment there is sent into the reeds 19, 20 water at high pressure which emerges at the level of the lance heads in the form of jets perpendicular to the axis 14. Since the tubes are arranged at the level of the tube plate in regular checker pattern, the water jets can pass between the rows of tubes and thus reach, due to the fact of the oscillating movement of the heads, the different zones of the tube plate occuring on a line perpendicular to the axis 14. After some moments, the reeds 19, 20 are moved simultaneously towards the outside of the steam generator by a distance equal to the distance which separates two rows of consecutive tubes. Successive displacements are thus carried out so that the unclogging operation finishes when the two lance heads 11, 12 arrive simultaneously at the level of the peripheral zone of the tube plate. This procedure assures that the sludge detached during the passage of a water jet does not circulate over the tube plate so as to return to a zone which has already been cleaned and to be redeposited thereon.

Of course, the complete unclogging operation cannot be stopped upon unclogging of the sludge, but must simultaneously comprise removal of the sludge mixed with water coming from the lance heads.

To proceed with the evacuation of the sludge, the following are provided.

Since the water jets intended for the unclogging follow directions 13 going from the center of the steam generator outwards, the sludge detached is, under the action of the water jet, projected to the periphery of the tube plate 2. A rigid pipe 21is positioned on this peripheral zone of the tube plate 2 and extends approximately over the entirety of this zone.

Figure 7:
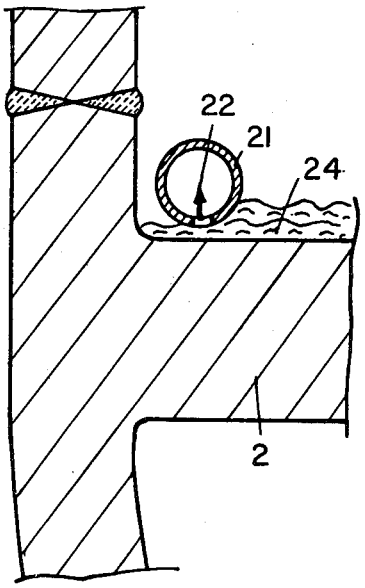
FIG. 7 is a view in partial section along the line D—D of FIG. 3.

FIG. 7 shows in detail an embodiment of pipe 21, showing in particular its position above the tube plate 2, at a short and regular distance therefrom. A row of holes 22 is arranged longitudinally at the lower part of pipe 21 which also corresponds to the zone of the pipe closest to the tube plate 2.

Since pipe 21 is connected to the outside by pumps designed to create a suction therein, the sludge 24 coming to the vicinity of it 21 passes into the pipe through the orifices 22.

Figure 6:
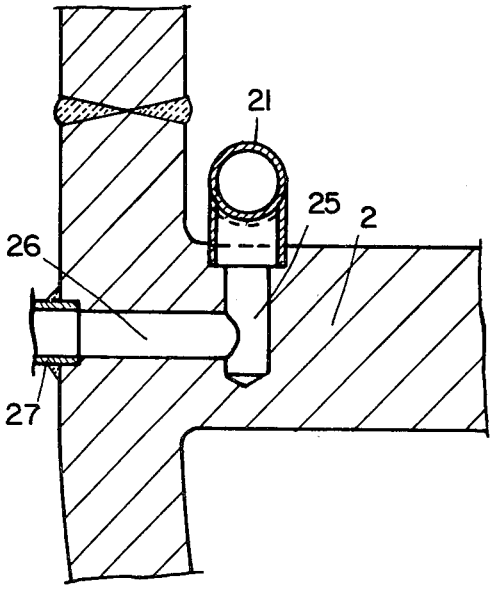
FIG. 6 is a view in partial section along the line C—C of FIG. 3.

FIG. 6 shows the connection between the pipe 21 and the outside of the steam generator. The pipe 21 is connected in fluid-tight manner to the tube plate in which various bores 25, 26 are pierced which create a communication between the inside of the pipe 21 and the outside of the steam generator, these orifices being connected by a conduit 27 to a pump intended to extract the sludge during the unclogging operation.

The pipe 21 is mounted and fixed permanently inside the steam generator. In the embodiment described, as is seen in FIG. 3, the pipe 21 is formed of several sections, here six in number, closed at the ends, each section 21, 21' including an independent communication with the outside of the generator. A set of pipe groups, through the conduits 27 27' each tube 21, 21' to an aspiration device with the interposition of a valve in each of the conduits, which permits, by different adjustment of each valve, local increases of the aspiration capacities in order to obtain good evacuation of the sludge over the totality of the periphery of the tube plate.

It is also possible to arrange at the peripheral part of the tube plate a pipe 21 forming a complete turn and including one or several connections with the outside of the steam generator.

It is also possible to simplify the evacuation device as shown in embodiment 4. In this Figure no peripheral tube at all is fixed to the inside of the generator provided, but only orifices are formed in the periphery of the tube plate 2 and connected to the outside of the steam generator, in the same manner as previously, to conduits going to as aspiration device. Although this simplified sludge evacuation device shown in FIG. 4 may be slightly less efficient than that shown in the other figures and including a peripheral pipe 21, the simplified version has the advantage of not requiring permanent installation of pipes 21 inside the steam generator.

Figure 4:
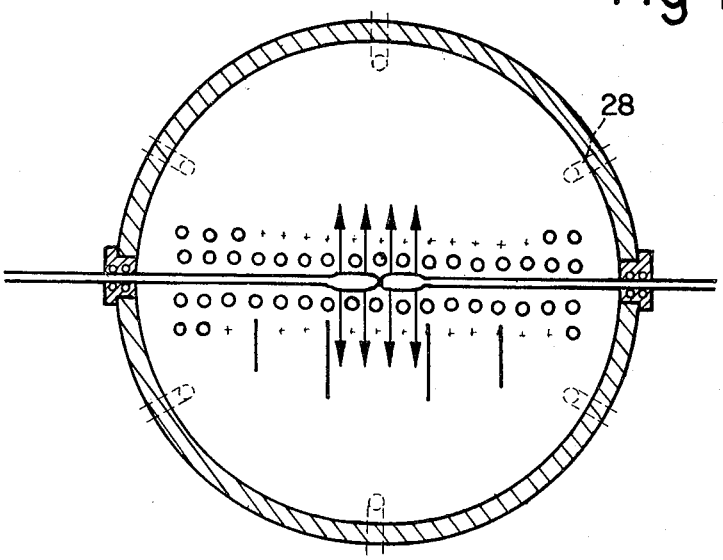
FIG. 4 is a view along the same section as FIG. 3 of a modification of the unclogging device.
Figure 5:
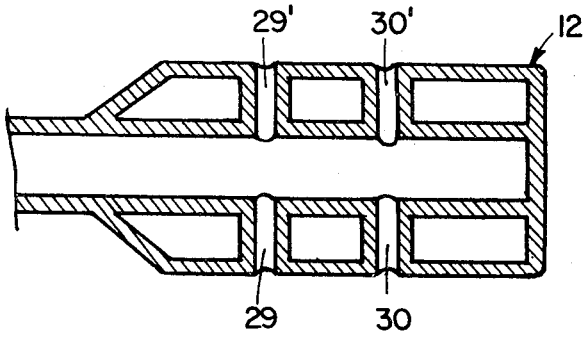
FIG. 5 is a sectional view of the projection head.

FIG. 5 shows a lance or projector head which comprises two pairs of lances 29, 29' and 30, 30'. The first pair of lances 29, 29' is arranged in a first plane perpendicular to the axis 14 and the second pair of lances 30 is arranged in a second plane perpendicular to the axis 14, the distance separating the lances 29 and 30 being equal to the distance between two consecutive rows of tubes constituting the bundle of tubes. In this way, as is seen in FIGS. 3 and 4, each lance carries out unclogging by sending simultaneously two jets on each side of the same tube, which effects high efficiency cleaning. On the other hand, lances 29 and 29' are arranged diametrically opposite with respect to the axis 14. The same is true for the lances 30 and 30'. This arrangement has the advantage of causing nullifying the reaction forces at the level of the lance heads, thereby permitting lighter and more reliable construction of the reeds which support these lance heads.

The method or the device for unclogging according to the invention enables the performance of the operation of recovering sludge to be improved since, due to the fact of the symmetrical action of the two heads, the jets move the sludge not only in the direction of the jets but also in a perpendicular direction. Thus, the sludge is repelled closer and closer towards the zones of the bundle where the number of rows of tubes is less, zones for which the efficiency of projection is increased.

By means of the arrangements according to the invention it is possible to leave permanently inside the steam generator all of the lance heads connected to their reeds 19, 20, on condition of having provided on the bearings 17, 18 sealing devices enabling the conditions of pressure and temperature existing inside the steam generator to be withstood.

It will be noted also that the device according to the invention enables the number of dismountable parts occuring inside the steam generator to be minimized, which simplifies the operational mode, enables a gain in time and reduces the risks of having to recover elements inside the steam generator in case of accident. Moreover, the fact of only having lances to introduce inside the steam generator permits the use of access apertures of small diameter.

The device according to the invention also permits, during the period of operation of the steam generator, operation of the sludge evacuation device mounted permanently inside the steam generator enabling periodic purging operations of the feed water to be carried out, which permits the deposition of sludge to be limited and consequently prolongation of the period separating two unclogging operations, which always necessitate stopping the operation of the steam generator.

What is claimed is:

1. Method for unclogging the top surface of the tube plate of a steam generator comprising, in a cylindrical vessel of vertical axis, a vertical bundle of bent tubes of inverted U-shape, each connected at their lower ends to the flat horizontal tube plate fast to the vessel of the steam generator, a fluid at high temperature being conducted to the tubes of the bundle beneath the tube plate to provide the heat enabling vaporization of the feed water introduced into the steam generator on contact with the tubes, said method comprising an operation of unclogging sludge by positioning in the vessel containing the tube bundle, two water jets at high pressure which can be directed towards different points of the tube plate, one of the water jets sweeping a first semi-circular zone of the tube plate, the other water jet sweeping the complementary semi-circular zone of the tube plate, these two water jets moving simultaneously and symmetrically with respect to the diametric boundary line of these two zones of the tube plate, this movement taking place from said diametric line to the periphery of the stream generator, and comprising a simultaneous evacuation operation for sludge detached by the water jets, by effecting aspiration of this sludge throughout the length of the peripheral zone of the tube plate.

2. Unclogging device for the upper surface of the tube plate of a steam generator comprising, in a cylindrical vessel with a vertical axis, a vertical bundle of bent tubes of inverted U-shape, each of said tubes being connected at each of its lower ends to the flat horizontal tube plate fast to the vessel of the steam generator, a fluid at high temperature being led to the tubes of the bundle beneath the tube plate to provide heat enabling vaporization of the feed water introduced into the steam generator in contact with the tubes, said device comprising (a) two projection heads connected to means for supplying water under pressure, said heads being located above said tube plate and having nozzles directed toward said tube plate;

(b) means for displacing said projection heads simultaneously in a direction diametral to said steam generator passing between the branches of said U-shaped tubes, in such manner that the position of said two projection heads always remains symmetrical with respect to the vertical axis of said steam generator, so as to sweep symmetrically the whole of said tube plate;

(c) means for causing oscillating movement of said two projection heads about said diametral displacement direction, so as to sweep the upper surface of said tube plate; and (d) means for evacuating sludge comprising at least one pipe located at a slight distance above said tube plate at its periphery adjacent said vertical cylindrical vessel, said pipe having downwardly directed orifices and being branched to a conduit leading to the exterior of said steam generator and connected to a suction device for evacuation of said sludge.

3. Unclogging device according to claim 2, wherein said pipe comprises a plurality of independent successive sections, closed at each end, each of said sections being connected to said suction device.

4. Unclogging device for the upper surface of the tube plate of a steam generator comprising, in a cylindrical vessel with a vertical axis, a vertical bundle of bent tubes of inverted U-shape, each of said tubes being connected at each of its lower ends to the flat horizontal tube plate fast to the vessel of the steam generator, a fluid at high temperature being led to the tubes of the bundle beneath the tube plate to provide heat enabling vaporization of the feed water introduced into the steam generator in contact with the tubes, said device comprising (a) two projection heads connected to means for supplying water under pressure, said heads being located above said tube plate and having nozzles directed towards said tube plate;

(b) means for displacing said projection heads simultaneously in a direction diametral to said steam generator passing between the branches of said U-shaped tubes, in such manner that the position of said two projection heads always remains symmetrical with respect to the vertical axis of said steam generator, so as to sweep symmetrically the whole of said tube plate;

(c) means for causing oscillating movement of said two projection heads about said diametral displacement direction, so as to sweep the upper surface of said tube plate; and (d) means for evacuating sludge comprising a plurality of orifices at the periphery of said tube plate and connected to the exterior of said steam generator, to a suction device.

* * * * *